United States Patent [19]

Bendit

[11] Patent Number: 4,681,463

[45] Date of Patent: Jul. 21, 1987

[54] DIFFERENTIAL TIMER

[76] Inventor: Kurt J. Bendit, 3927 19th St., San Francisco, Calif. 94114

[21] Appl. No.: 906,856

[22] Filed: Sep. 12, 1986

[51] Int. Cl.[4] ..... G04F 3/00

[52] U.S. Cl. ..... 368/96; 368/77; 368/110

[58] Field of Search ..... 368/96, 107–113, 368/77, 233

[56] References Cited

U.S. PATENT DOCUMENTS

| | | | |
|---|---|---|---|
| 2,539,754 | 2/1947 | Rettinger | 368/96 |
| 3,698,180 | 10/1972 | Klein | 368/96 |
| 3,878,675 | 4/1975 | Prociuk | 368/96 |
| 3,961,473 | 6/1976 | Hung | 368/96 |
| 3,984,109 | 10/1976 | Wiles | 368/96 |
| 4,021,046 | 5/1977 | Barlois | 368/96 |
| 4,362,393 | 12/1982 | Tissot | 368/96 |

FOREIGN PATENT DOCUMENTS 281468 6/1952 Fed. Rep. of Germany .

*Primary Examiner*—Vit W. Miska

*Attorney, Agent, or Firm*—Townsend & Townsend

[57] ABSTRACT

A timing device is provided for the differential timing of game play, such as chess, employing an easily readable display means and an accurate timing means. According to the preferred embodiment of the present invention, the display means further comprises two concentric articulating discs of different color, usually black and white. The display is connected to an electric motor driven by an accompanying electric circuit such that one disc is driven by the motor. The direction of travel of the motor is controlled by player actuated switches which are tripped upon completion of each move. Differential time is displayed by the eclipse of one disc by the other.

7 Claims, 9 Drawing Figures

DIFFERENTIAL TIMER

BACKGROUND OF THE INVENTION

Field of the Invention

The present invention relates generally to timing devices and, more particularly to a device for indicating differential time during game play.

A number of presently known games playable by two persons, such as chess or checkers, have been adapted to timed play; players have a finite period of time to move a piece or complete a game. For the most part, such timed play employes devices that indicate elapsed time, such as the two-clock-face device disclosed in U.S. Pat. No. 2,539,754. Such devices pit each player against their respective clocks as well as each other.

An alternate method of timing is to indicate differential time, that is, were time consumed by one player in making a decision and move a piece or the like (collectively called a move) is added to the time the second player has for his move. Such differential timing heightens the competition between players since not only does a player consume time during a move, but he also aides his opponent by adding time for the opponent's next move.

Prior art devices for differential timing, discussed below, are characterized by being awkward to view and/or inaccurate. There is therefore a need for an accurate device which can simply be glanced at by a player to determine time remaining for the player's event.

Description of the Prior Art

U.S. Pat. No. 4,362,393 discloses the use of electronic, portable pocket calculators to provide an elapsed timing apparatus for speed chess. Speed chess is well known in the art wherein each player is given a relatively short time period (such as five minutes) in which to play a complete game.

U.S. Pat. No. 3,984,109 discloses a chess game in which hollow translucent chess pieces of two different colors which carry lamps within their interiors. A control unit includes a timer means for alternately turning on transmitters for the different control signals for a predetermined period of time such as 30 seconds for indicating the time period in which to move and which color is to move.

U.S. Pat. No. 3,961,473 discloses a digital timer for indicating the time for completing moves in a chess match.

U.S. Pat. No. 3,878,675 discloses an assembly of spaced chess clocks.

U.S. Pat. No. 3,698,180 discloses an automatic circuit to control the running of respective players' time clocks without any direct manual intervention.

U.S. Pat. No. 2,539,754 discloses a combination timer and move counter for chess game employing dual electric clocks.

German Pat. No. 281,468 discloses a checker board equipped with dual clock mechanisms.

Conventional game clocks have been employed for differential timing. This is usually accomplished by using a two clock timer such as that disclosed in U.S. Pat. No. 2,539,754 by calculating from the time on the respective clocks. For example, in chess, a ten minute differential is agreed upon. Both clocks are set at 6:00. White has until 6:10 on his clock before he runs out of time and forfeits. Assume he takes only five minutes to complete his move. Black now has until 6:15 on his clock before he runs out of time and forfeits. In effect, the player whose clock out-distances the opponent's clock by more than ten minutes loses. Forfeit occurs anywhere around the dial when the "winner can prove that the ten minute differential has indeed been exceeded by the "loser".

An alternate method found in the prior art employs a three minute "hour glass" style egg timer, wherein the sand is distributed evenly between the two lobes. In chess, play begins with white turning the timer upright, beginning the flow of sand. When white's move is completed, the timer is turned over and black has his original half of the sand plus that used by white. Play continues as long as neither player runs out of sand. This method is inadequate because of the lack of accuracy with respect to dividing the sand at the start of play.

SUMMARY OF THE INVENTION

A novel timing device is provided for the differential timing of game play, such as chess, employing an easily readable display means and an accurate timing means. According to the preferred embodiment of the present invention, the display means further comprises two concentric articulating discs of different color, usually black and white. The display is connected to an electric motor driven by an accompanying electric circuit such that one disc is driven by the motor. The direction of travel of the motor is controlled by player actuated switches which are tripped upon completion of each move. Differential time is displayed by the eclipse of one disc by the other. That is, the time interval for play is displayed as a proportion of the time allotted for the first player to move to that for the second player.

DETAILED DESCRIPTION OF THE SPECIFIC EMBODIMENTS

Figure 1A:
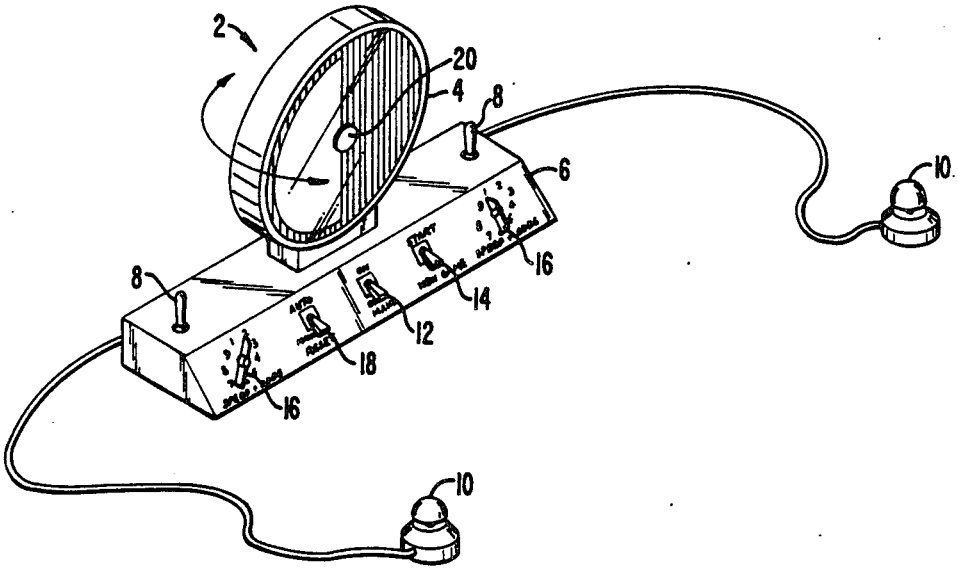
FIG. 1A is a view-in-perspective of a differential timing device according to the present invention.
Figure 3A:
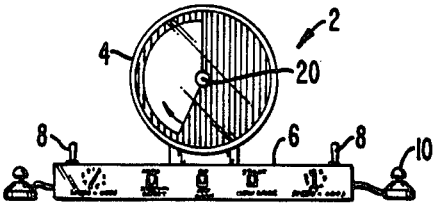
FIG. 3 is a view-in-perspective of a sequence of displays during game play.
Figure 3B:
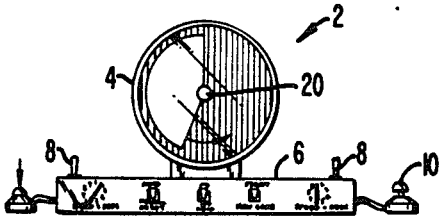
Figure 3C:
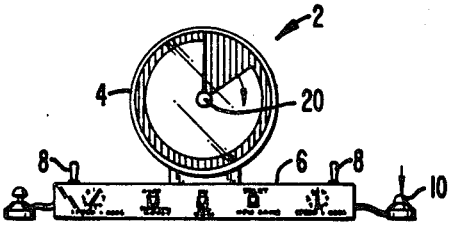
Figure 3D:
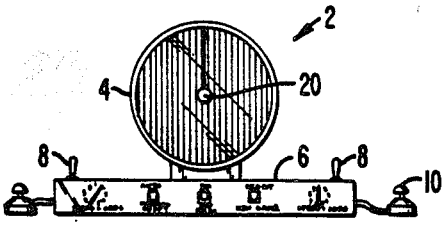
Figure 1B:
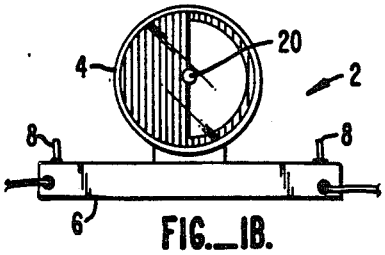
FIG. 1B is a rear view of the present invention, showing the configuration of the opposite side of the display.

Referring to FIG. 1, the preferred embodiment of the present invention is shown in perspective view. Differential timer 2 comprises display 4 and base 6. Player actuated local switches 8 and remote switches 10 are provided for tripping by each player upon completion of his move. Base 6 has disposed thereon main power switch 12, start switch 14, odds/motor speed switches 16 and reset switch 18. Move indicator light 20 is disposed in the center of display 4. An explanation of the operation of each of the above features follows.

Figure 2:
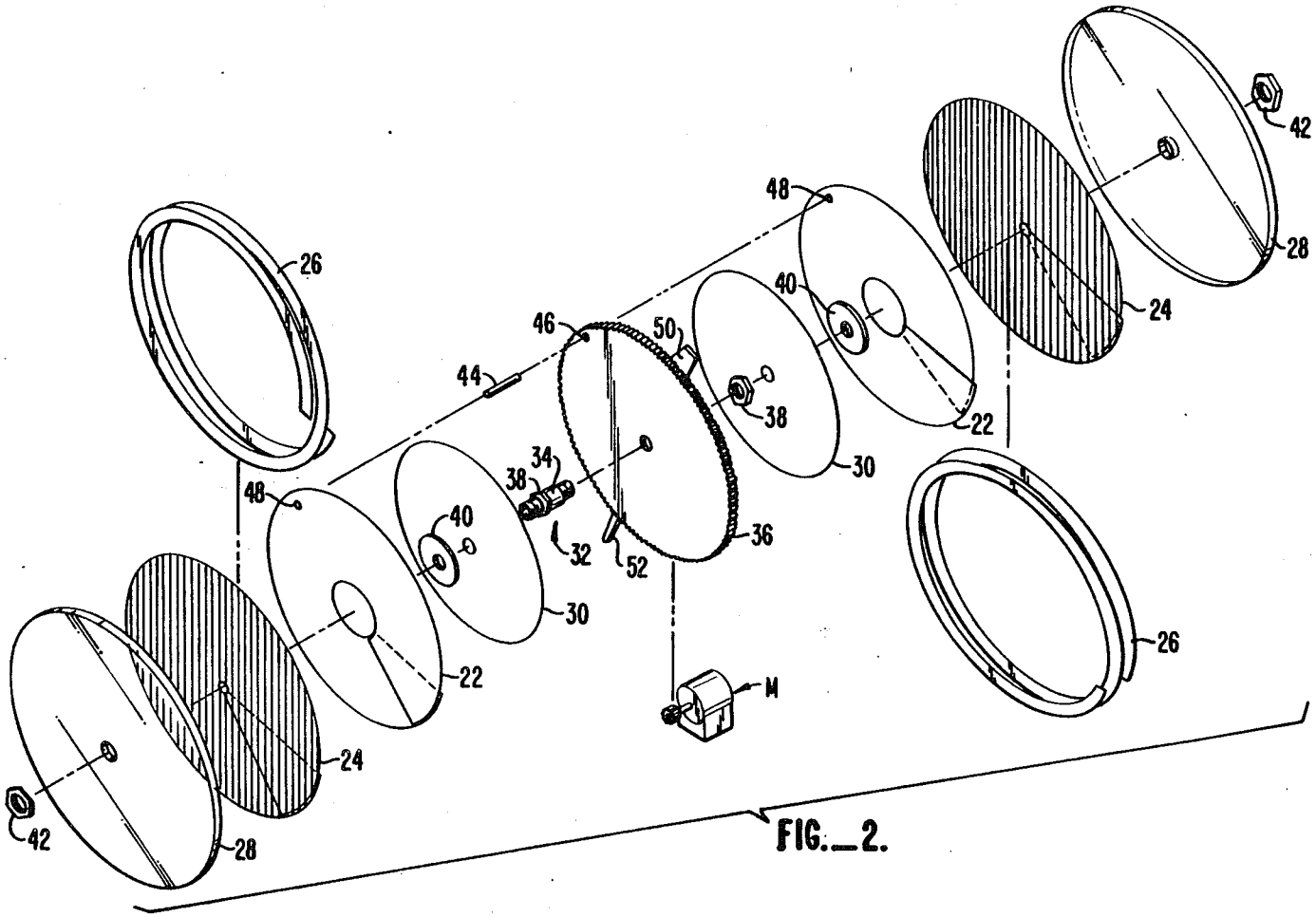
FIG. 2 is an exploded view of the display of the preferred embodiment of the present invention.

FIG. 2 depicts an exploded view of display 4 which comprises articulating discs 22 and 24 which are visually distinguishable from each other, spacer means 26, face plate 28 and back plate 30. These components are disposed on spindle means 32 in duplicate as shown in FIG. 2, wherein spindle means 32 comprises a hollow tube threaded at each end with an un-threaded portion 34 centrally disposed on the tube. Gear 36 is formed in size and shape such that it rotates freely about un-threaded portion 34 such that portion 34 acts as a bearing for gear 36.

After gear 36 is placed on spindle means 32, backing nuts 38 are threaded onto the spindle without applying pressure on gear 36. Back plates 30 are then placed on spindle means 32 followed by washers 40. Washers 40 are formed in size and shape such that discs 22 ride on the outer surfaces of washers 40, with the surfaces acting as bearings.

The discs 22 and 24 are formed in size such that disc 24 is of greater circumference than spacer 26 and disc 22 of slightly lesser circumference. This structure allows the discs to be assembled with disc 22 riding inside the inner surface of spacer 26. Once this assembly has been placed on spindle means 32, transparent face plate 28 is added to the spindle assembly and retaining nut 42 secured on spindle means 32. This assembly holds disc 24 in place while allowing the free rotation of gear 36 and discs 22 about spindle means 32.

Rotation of gear 36 is achieved by motor M. Motor M can be electric as in the preferred embodiment or mechanical, such as a spring driven device or the like. Rotation of discs 22 is achieved by transferring rotation of gear 36 circumferentially to discs 22 by means of a key 44 which passes through keyways 46 and 48. The motor is controlled by a control circuit described below. Gear 36 is provided with an occluder tab 50 and a trip tab 52, the functions of which are also described below.

Referring again to FIG. 1A, play begins by closing main power switch 12 and tripping start switch 14. Odds may be given by selecting the speed of the display for each player using switches 16. Upon forfeiture or the end of play, reset switch 18 is tripped and the display returns to half black and half white. Upon completion of play, display 4 is rotated 180 degrees, placing the black and white halves on opposite sides. In this way it is not necessary to move the entire clock when players switch colors.

FIG. 3 shows display 4 as it appears during game play. In FIG. 3A, white is moving and consuming time while adding time to black. In FIG. 3B, black is moving and consuming time while adding time to white. In FIG. 3C, white is moving again and in FIG. 3D, white has forfeited as indicated by the solid black display.

Figure 4:
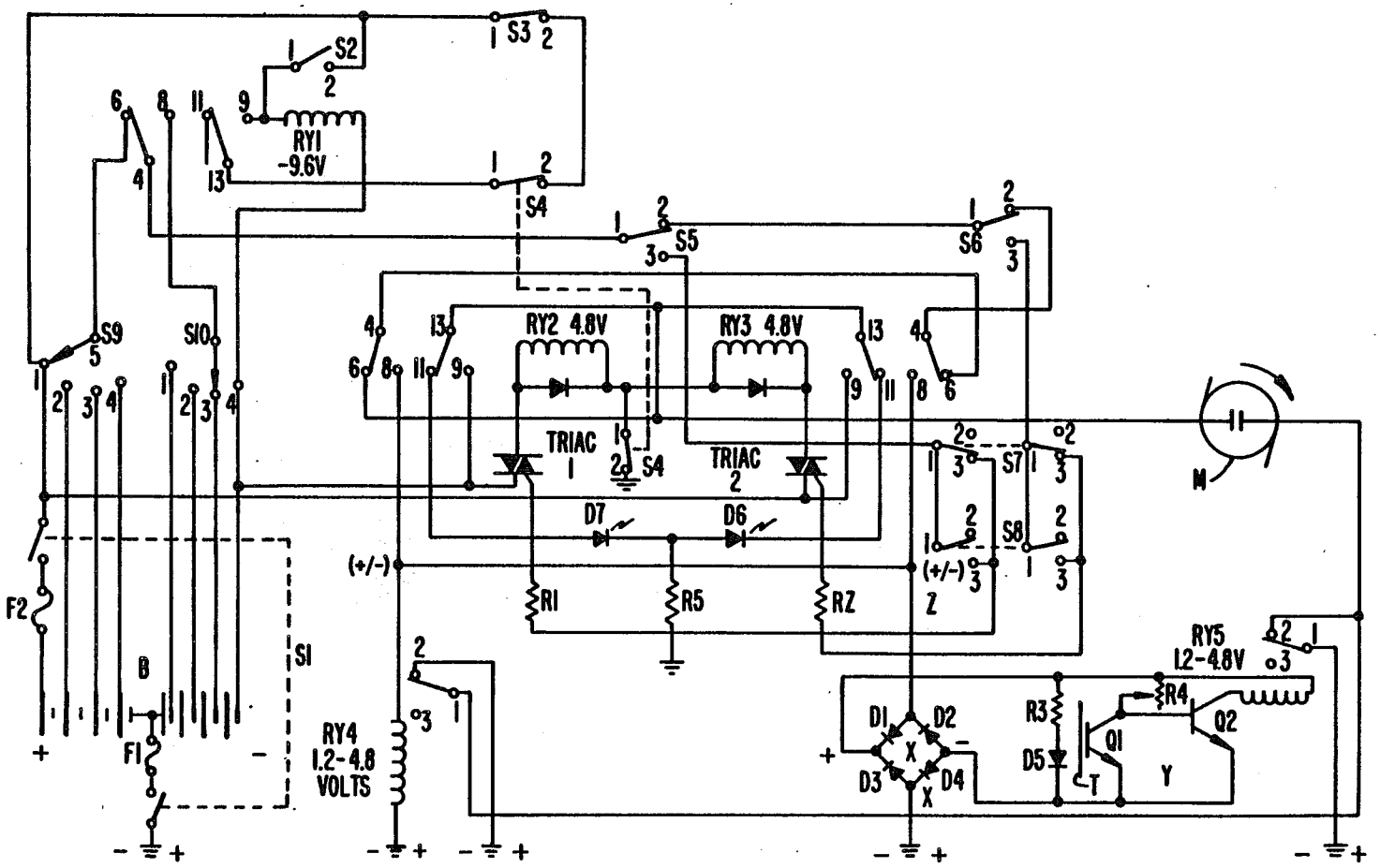
FIG. 4 is a circuit diagram of the preferred embodiment of the present invention.

Referring to FIG. 4, note that switch S9 couples all 4 battery cells to drive the motor M when white is moving, so that the motor M moves at full speed. However, switch S10 couples only 3 battery cells when black is moving. Thus, the display moves at only ¾ speed when black is moving. Therefore, in this example, white has given black 4:3 odds.

Assume the game is in progress and white is moving. Current flows from positive 4.8 volt terminal of plus/-minus supply through fuse F2 through pole A of S1 through 1 & 5 of S9 through 6 & 4 of RY1 through 1 & 2 of S5 through 1 & 2 of S6 through 4 & 6 of RY3 through 4 & 6 of RY2 to the motor *and* through 11 & 13 of RY2 to forward biased D7. From the motor through 1 & 2 of both RY5 and RY4 through pole B of S1 through F1 to common of supply, and from D7 through R5 to common of supply. The motor is running clockwise and the move indicator light D7 (indicator light 20) is green. Next white completes his move and trips S2 (by switches 8 or 10 in FIG. 1), beginning the timing of black's move.

Current flows from positive 4.8 volt terminal of plus/minus supply through F2 through pole A of S1 through 1 & 2 of S2 to coil of RY1 to negative 4.8 volt terminal of plus/minus supply. Now current flows from 2 of S2 through 1 & 2 of S3 through 2 & 1 of S4 through 13 & 9 of RY1 to coil of RY1 to negative 4.8 volt terminal of plus/minus supply. RY1 is now effectively latched until black moves and trips S3 or until S4 is tripped by either player. Now current also flows from the negative 3.6 volt terminal of the plus/minus supply through 3 & 5 of S10 through 8 & 4 of RY1 through 1 & 2 of S5 through 1 & 2 of S6 through 4 & 6 of RY3 through 4 & 6 of RY2 to the motor *and* through 11 & 13 of RY3 to forward biased D6. From the motor through 1 & 2 of *both* RY5 and RY4 through pole B of S1 through F1 to common of supply; and from D6 through R5 through pole B of S1 through F1 to common of supply. The motor is running counter-clockwise at ¾ of full speed and the move indicator light 20 is red.

Now, assume that black has moved and tripped S3 (by switches 8 or 10 in FIG. 1), but white is unable to move and forfeits the game. The display goes completely black and trips S5 (by tab 52 in FIG. 2). Current flows from positive 4.8 volt terminal of plus/minus supply through F2 through pole A of S1 through 1 & 5 of S9 through 6 & 4 of RY1 through 1 & 3 of S5 through 1 & 3 of S7 through R1 to gate of Triac 1 to negative 4.8 volt terminal of plus/minus supply. From the same negative 4.8 volt terminal of plus/minus supply through Triac 1 through coil of RY2 through 1 & 2 of S4 to common of supply. RY2 is now effectively latched until S4 is tripped. Current now flows from negative 4.8 volt terminal of supply through 9 & 13 of RY2 to the motor. Current also flows through 13 & 11 of RY3 to forward biased D6. Contacts 1 & 2 of S5 now close again and current passes from positive 4.8 of supply through 1 & 5 of S9 through 6 & 4 of RY1 through 1 & 2 of S5 through 1 & 2 of S6 through 4 & 6 of RY3 through 4 & 8 of RY2 to coil of RY4 as well as to point "Z" and bridge "X". Current also flows from motor through 2 & 1 of only RY5 to common of supply and from D6 through R5 to common of supply and from coil of RY4 to common of supply. The motor is now running counterclockwise at full speed. The move indicator light is red and RY4 and RY2 are both latched until S4 is tripped by occluder 50 as shown in FIG. 2. Current flows from bridge "X" to common of supply.

Similarly, assume white has moved, tripped S2, and that black forfeits. The display trip tab 36 trips switch S6. Current flows from negative 3.6 volt terminal of plus/minus supply through 3 & 5 of S10 through 8 & 4 of RY1 through 1 & 2 of S5 through 1 & 3 of S6 through 1 & 3 of S7 through R2 to gate of Triac 2 to positive 4.8 of supply. Current then flows from the same positive 4.8 of supply through Triac 2 through coil of RY3 through 1 & 2 of S4 to common of supply. RY3 is now effectively latched until S4 is tripped. Current now flows from positive 4.8 of supply through 9 & 13 of RY3 to the motor. Current also flows through 13 & 11 of RY2 to forward biased D7. Contacts 1 & 2 of S6 now close and current passes from negative 3.6 of supply through 3 & 5 of S10 through 8 & 4 of RY1 through 1 & 2 of S5 through 1 & 2 of S6 through 4 & 8 of RY3 to point "Z", coil of RY4 and to bridge "X". Current also flows from the motor through contacts 2 & 1 of only RY5 to common of supply and from D7 through R5 to common of supply and from coil of RY4 to common of supply and from bridge "X" to common of supply. The motor is running clockwise at full speed. The move indicator light 19 is green and RY4 and RY5 are both latched until S4 is tripped.

Whenever forfeit occurs, motor (at whatever speed) will upon command or automatically reverse direction and run at full speed until the photo-interrupter "Y" stops it. This takes place when the dial is half white and half black and the photo-interrupter is tripped by tab 50 as shown in FIG. 2.

Voltage at point "Z" is positive or negative (+ or −) depending on which player just forfeited. RY4 is not polarity sensitive while photo-interrupter "Y" is. Rectifier bridge "X" steers the proper polarity to "Y" no matter who forfeits. While the motor is moving toward equal division of the display 4 between black and white, current flows through forward biased D5 through R3. Current flows through forward biased emitter/base junction of Q1 and through the collector and R4. Q2 junction is reverse biased and RY5 remains deenergized and contacts 2 & 1 are closed and the motor keeps moving until trip tab 36 trips photo-interrupter "Y". Now Q1 is reverse biased, the base at Q2 goes positive and the transistor conducts current. RY5 energizes, contacts 2 & 1 open, the motor stops, the display 4 is equally divided and a new game can begin upon tripping of S4 (start switch 14).

Figure 5:
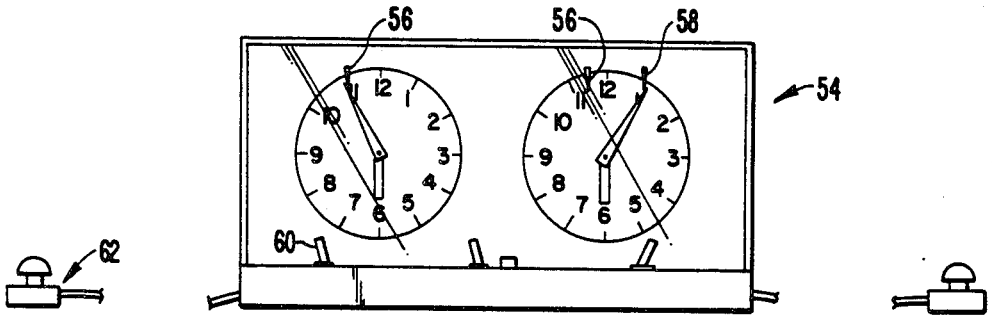
FIG. 5 is a front view of an alternate embodiment of the present invention.

Referring to FIG. 5, an alternate embodiment of the present invention is provided employing a conventional style two clock timer 54. The timer is adapted to display conventional elapsed time, wherein both clocks run at alternate times in a clockwise direction, or differential time, wherein both clocks run at the same time in the same direction, either clockwise or counterclockwise, depending on whose turn it is to move. It is well within the skill of the art to construct this alternate embodiment such that the speed of the clocks can be varied in either direction in order to give odds as in the preferred embodiment. Both clocks are provided with conventional flag 56, such that as the minute hand passes 11:00 it begins to raise flag 56 and at exactly 12:00 the minute hand moves from under flag 56 and the flag drops. The right clock is provided with an additional flag 58. In the differential mode the left clock is always oriented toward the player with the white pieces. Flag 56 of the right clock (black's) is retracted and replaced with flag 58. For ten minute (an arbitrary period) differential play, white's clock is set at 5:55 and black's at 6:05. Assuming it is whites move, both clocks are running clockwise and white's flag 56 is rising as white's minute hand approaches 12:00. Black's minute hand is retreating from 12:00, leaving flag 58 "limp". White completes his move and actuates switch 60 or 62, causing the clocks to move counter-clockwise. White's minute hand now retreats from 12:00 while black's approaches, raising flag 58. Forfeit is determined by whose flag "falls" at exactly 12:00.

It is within the skill of the art to construct a digital version of the present invention given the above disclosure of present invention. The motor mechanism of the preferred embodiment would be replaced with a digital clock, usually in the form of an up/down timer, in a digital device.

As can be appreciated from the foregoing description of the subject invention, a timing device for the differential timing of game play is provided. The device overcomes the problems of the prior art by providing an easily readable display and accurate timing means. The invention also provides means for giving odds between players.

Although the present invention has been described in some detail for purposes of clarity and understanding, it will be obvious to those skilled in the art that certain changes and modifications may be practiced within the scope of the appended claims.

What is claimed is:

1. A device for indicating differential time during game play comprising:

a reversible motor;

means for allocating a time interval between a first move and a second move;

means for selecting between said first and said second move; and means for displaying said time interval in proportion to said first move and said second move.

2. A device for indicating differential time during game play according to claim 1, wherein said allocating means and said display means comprise:

an articulated disk assembly having a first disk and a second disk, said first disk being visually distinguishable from said second disk.

3. A device for indicating differential time during game play according to claim 1, wherein said articulating disk assembly is circumferentially driven by said motor.

4. A device for indicating differential time during game play according to claim 1, wherein said selecting means comprises:

a player actuatable, two position switch.

5. A device for indicating differential time during game play comprising:

a reversible motor;

an articulated disk assembly having a first disk and a second disk, said first disk being visually distinguishable from said second disk, said disk assembly driven by said motor; and a player actuatable, two position switch, said switch reversing the direction of travel of said motor.

6. A device for indicating differential time during game play comprising:

a clock;

means for allocating a time interval between a first move and a second move;

means for selecting between said first and said second move; and means for displaying said time interval in proportion to said first move and said second move.

7. A device for indicating differential time during game play according to any of claims 1, 5, or 6, further comprising:

means for giving odds to either player.

* * * * *